US005152591A

United States Patent [19]

Beals

[11] Patent Number: 5,152,591

[45] Date of Patent: Oct. 6, 1992

[54] METAL DESK PANEL AND ASSEMBLY

[75] Inventor: Ralph Beals, Muscatine, Iowa

[73] Assignee: Hon Industries Inc., Muscatine, Iowa

[21] Appl. No.: 653,714

[22] Filed: Feb. 11, 1991

Related U.S. Application Data

[63] Continuation-in-part of Ser. No. 279,330, Dec. 2, 1988, Pat. No. 5,102,210, which is a continuation of Ser. No. 030,052, Mar. 24, 1987, abandoned.

[51] Int. Cl.[5] ..... A47B 47/00

[52] U.S. Cl. ..... 312/195

[58] Field of Search ..... 108/27, 51.3, 111; 312/257.1, 263, 194, 195

[56] References Cited

U.S. PATENT DOCUMENTS

| | | |
|---|---|---|
| 1,581,257 | 4/1926 | Wege . |
| 1,873,932 | 8/1932 | Hunter . |
| 1,879,665 | 9/1932 | Ekvall . |
| 2,163,049 | 6/1939 | Merrill . |
| 2,533,313 | 12/1950 | Flicker . |
| 2,535,593 | 12/1950 | Murray . |
| 2,703,742 | 3/1955 | Becker . |
| 2,943,898 | 7/1960 | Knuth . |
| 3,255,721 | 6/1966 | Peterschmidt . |
| 3,339,504 | 9/1967 | Schreyer . |
| 3,439,466 | 4/1969 | Schreyer . |
| 3,871,726 | 3/1975 | Stegner . |
| 4,110,052 | 8/1978 | Polvara ..... 108/111 |

*Primary Examiner*—Joseph Falk
*Attorney, Agent, or Firm*—Leydig, Voit & Mayer

[57] ABSTRACT

A lightweight and rigid panel construction for a desk top having a unitary rectangular thin sheet metal top with integral channels along its longitudinal edges. Sheet metal reinforcing channels disposed along the longitudinal edges and the underside of the sheet metal wherein the channels are engaged by protrusions or plugs of a rigid end cap to provide structural support. A U-shaped tubular leg structure engages in the ends of the channels and is retained by the end cap for an end support.

22 Claims, 2 Drawing Sheets

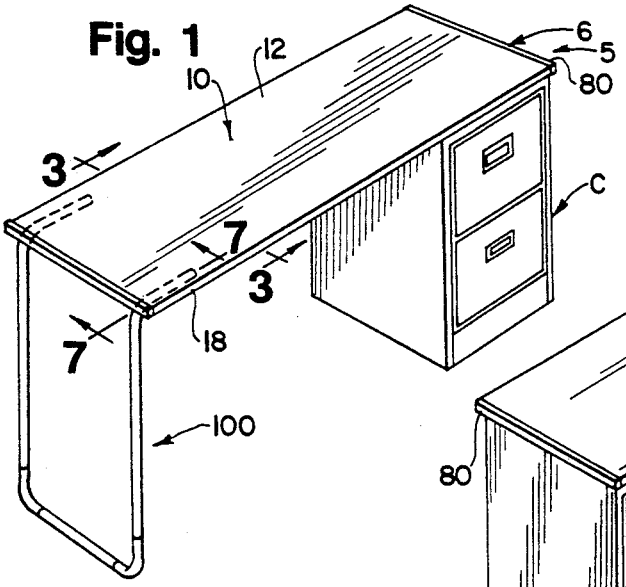
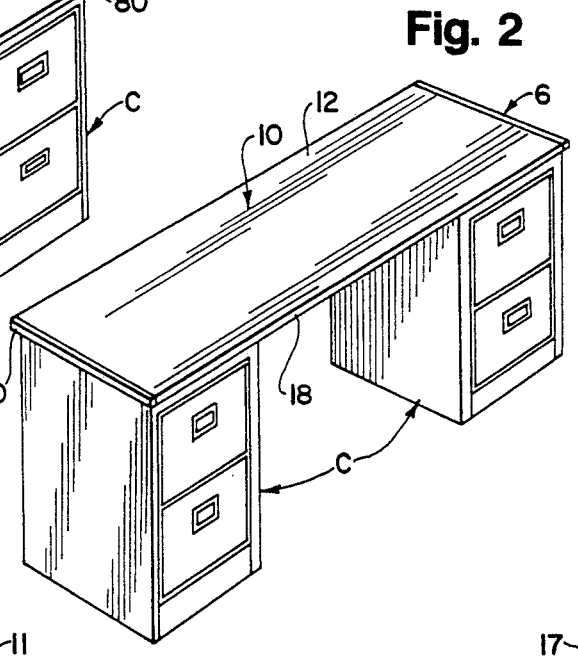
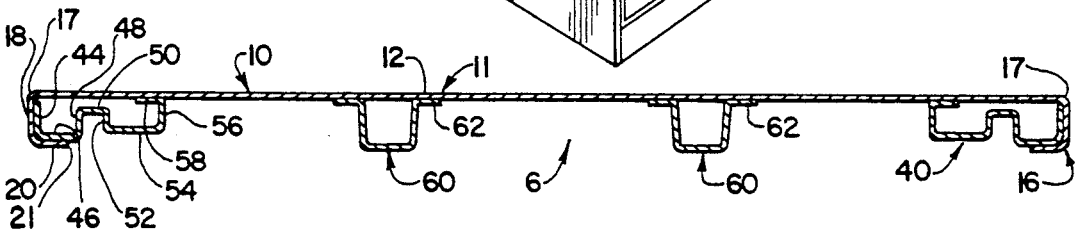
Fig. 3
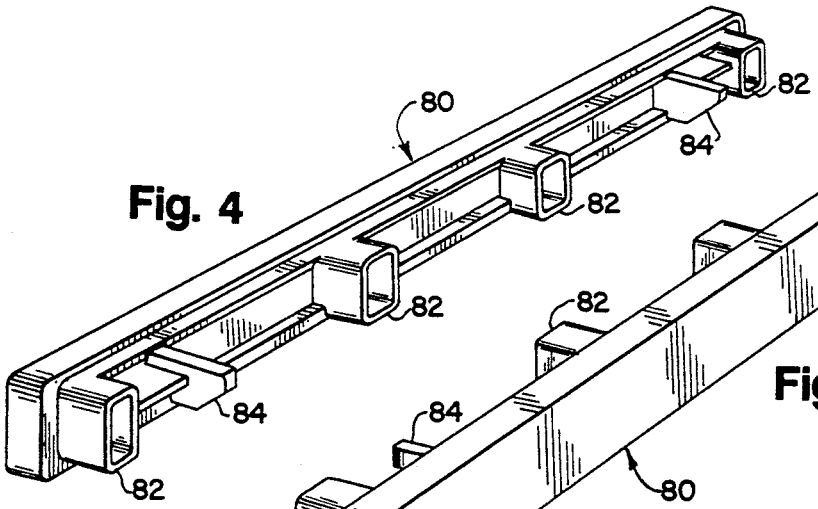
Fig. 4
Fig. 5

Fig. 6
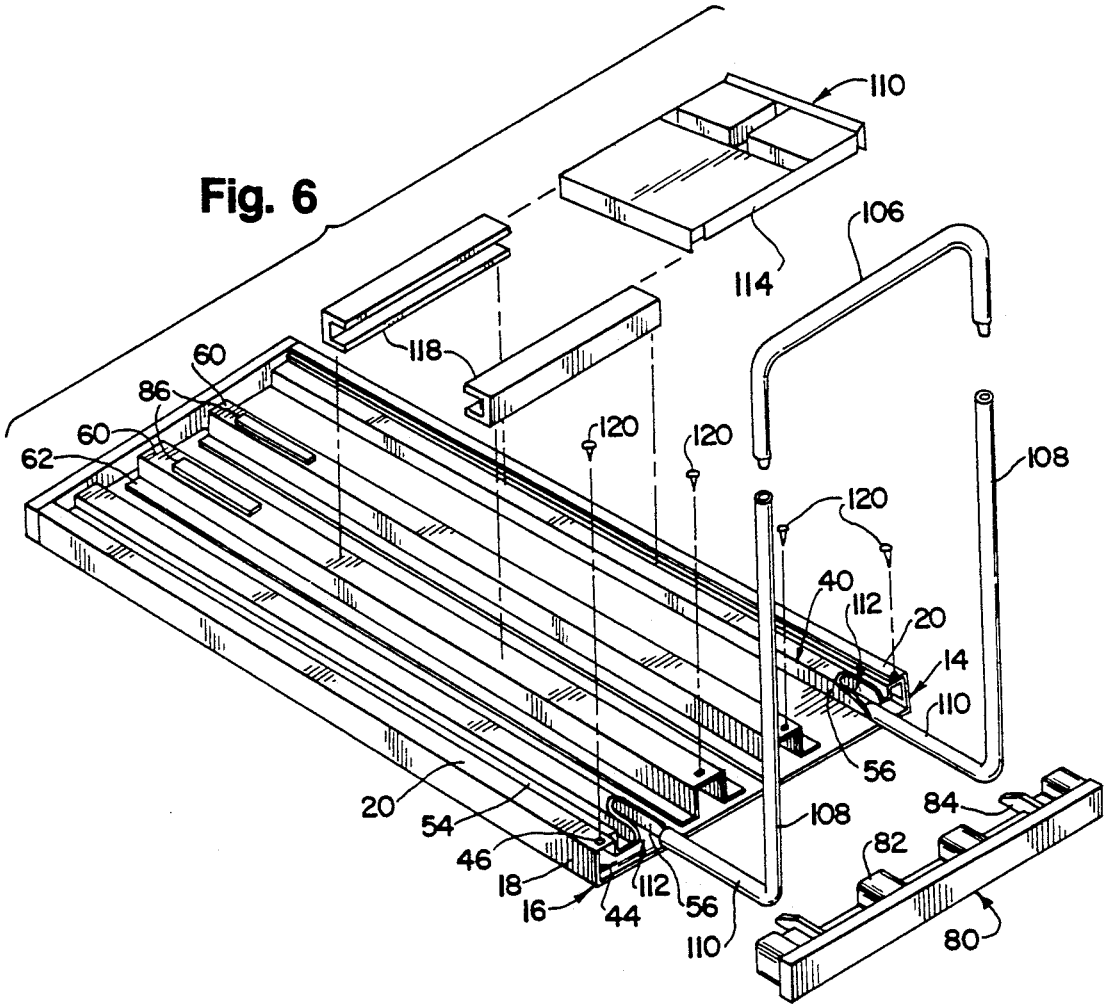
Fig. 7
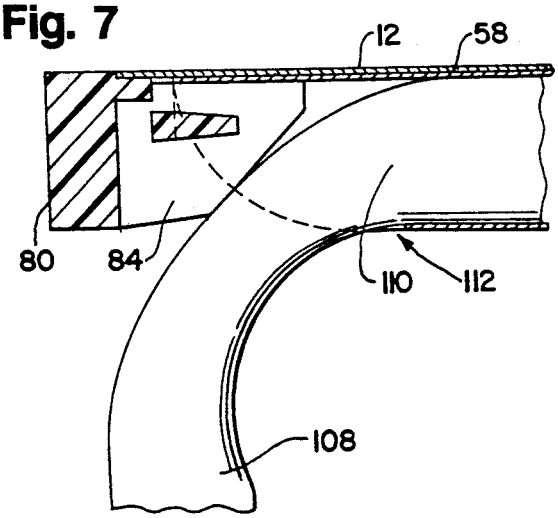
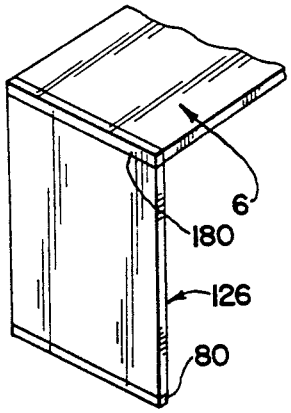
Fig. 8

METAL DESK PANEL AND ASSEMBLY

CROSS REFERENCE TO RELATED APPLICATION

This application is a continuation-in-part of application Ser. No. 07/279,330, now U.S. Pat. No. 5,102,210 filed Dec.2, 1988, now pending, which is a continuation of U.S. Ser. No. 07/030,052, filed Mar. 24, 1987, now abandoned. Those applications relate to the fabrication of filing cabinets of thin, preferably prefinished, sheet metal by adhesive lamination of components which effects strength and ruggedness. The disclosure of those applications is incorporated herein by reference.

FIELD OF THE INVENTION

The present invention relates to the construction of inexpensive furniture, and specifically to a desk top. More particularly, the present invention relates to a lightweight, sturdy furniture panel made from thin sheet metal as well to combinations for using such panels in desk assemblies.

BACKGROUND OF THE INVENTION

It has long been desirable to produce inexpensive, lightweight metal furniture for domestic and commercial use. Until recently, heavy gauge metal was required for office furniture such as desks and file cabinets to provide adequate support for office appliances such as typewriters and computers. Because many of the component parts of such furniture were secured by rivets, screws or bolts, or by welding which produced burn marks on the metal, additional manufacturing steps for decoration were required after the furniture was assembled.

OBJECTS OF THE INVENTION

It is an object of this invention to produce a lightweight but sturdy furniture panel using very thin sheet metal. It is a more specific object of the invention to provide an inexpensive desk top. It is another object of this invention to create a lightweight furniture panel that can be assembled from pre-decorated sheet metal and avoid post-assembly finishing, which substantially reduces manufacturing time and cost.

It is yet another object of this invention to produce a lightweight and sturdy furniture panel that can incorporate existing furniture as support means or may itself act as a support means to provide an inexpensive but sturdy desk assembly.

SUMMARY OF THE INVENTION

The present invention provides a lightweight and rigid furniture panel utilizing very thin sheet metal that reduces manufacturing time and cost.

A panel structure is provided using a thin decorated sheet metal panel formed with integral support channels along its longitudinal edges to provide a planar sturdy surface. The sheet metal may be less than .02 inches thick. Channels of similar metal are laminated to the underside and rigid supports engage each end to provide a furniture panel structure of sufficient rigidity to support normally expect loads, including any of the commonly used business and home apparatus normally situated on a desk top without sagging In a presently preferred desk top panel structure the top surface portion and two opposed finished side edge portions are formed from a single piece of thin sheet metal wherein the opposed side edge portions are formed by folding the sheet metal into a "C" channel along its longitudinal edges. A double channel edge reinforcement rib member also formed of the thin sheet metal extends the full length along the underside of each longitudinal edge. A portion of each reinforcement member nests within the respective "c"-channel formed by the folded finished side edge portions of the top surface portion and is laminated thereto. The other portion of each double channel reinforcement has an outwardly extending flange laminated to the underside of the top. Spaced hat shaped reinforcing ribs formed of the thin sheet metal also extend longitudinally the full length of the underside of the top to provide additional support. These hat shaped reinforcing ribs include outwardly extending flanges which are laminated by adhesive to the underside of the table top. A rigid end cap at each end of the panel has several spaced protrusions or plugs received in the non-folded or open ends of the furniture panel and engaging the corresponding channels formed by the hat shaped supports and the double channel edge supports. The end cap piece snuggly fits into the respective open end of the table top to provide lateral support and maintain the spacing of the sheet metal edges. Planeness of the top surface thereby is maintained.

The ends of the furniture panel may rest on two like or unlike support means such as file cabinets, legs, or the like to support each end of the panel leaving knee space beneath the middle of the panel for a person to be seated.

In one embodiment tubular legs for supporting one end of the panel are inserted into channels formed by the double channel edge supports along each longitudinal side edge. The legs are held in this position by the end piece which has a pair of wedge shaped protrusions such that when the end piece is inserted into the open end of the furniture panel each wedge shaped protrusion abuts against the respective inserted leg to firmly maintain the seated leg in the channel.

As another alternative, tubular legs could be so inserted at both ends of the desk to provide a very aesthetically pleasing and appropriately sturdy desk or table.

BRIEF DESCRIPTION OF THE DRAWINGS

For a more complete understanding of this invention, reference should be made to the embodiment illustrated in greater detail in the accompanying drawings and described by way of an example of the invention. In the drawings:

FIG. 1 is a perspective view illustrating a desk assembly of the present invention.

FIG. 2 is a perspective view of an alternative embodiment illustrating support of the desk top panel by two file cabinets.

FIG. 3 is a sectional view of the desk top panel of FIG. 1, taken generally along line 3—3 of FIG. 1, illustrating the support channels and their lamination securement to panel.

FIG. rear perspective view illustrating an end piece as FIG 1.

FIG. 5 is a front perspective view illustrating an end piece as in FIG. 1.

FIG. 6 is an exploded bottom perspective view of the desk assembly of FIG. 1 illustrating the table top, legs and end piece structures FIG. 7 is a sectioned view taken along line 7—7 of FIG. 1 illustrating the cooperation between the leg, end piece and desk top panel.

FIG. 8 is a partial perspective view of an alternative embodiment illustrating another panel employing teachings of this invention being used as a support means for a desk top similar to that of FIG. 1, utilizing a double sided end cap.

While the invention will be described in connection with a preferred embodiment, it will be understood that it is not intended to limit the invention to that embodiment, but it is intended to cover all alternatives, modifications and equivalents as may be included within the spirit and scope of the invention as defined by the appended claims.

DETAILED DESCRIPTION OF THE INVENTION

Referring now to the drawings, the desk 5 includes top structural panel 6 generally comprising a unitary sheet metal panel 10, longitudinal edge support channels 40, longitudinal rib supports 60 and end support caps 80. A cabinet C provides a pedestal support for the panel 6 at one end and leg supports 100 engage and support the panel at the opposite distal end.

The sheet metal used to form top panel 10 is generally less than 0.02 inches thick. For example, in a commercial embodiment, 0.0195 inch thick sheet metal is used and is cut and formed from finish-coated stock. The thin sheet metal panel 10 includes a planar top portion 11 having a top support surface 12 and corresponding underside 13. The panel 10 is generally rectangular in shape having depending flanges in the form of 37 c"-channels 14 and 16 along the two longitudinal edges of the top portion 11. A fold 17 defines the junction between the top portion 11 and the respective channel 14, 16. The "c"-channels 14 and 16 each have a downwardly extending vertical flange 18 and an interiorly extending horizontal flange 20 having a terminal edge 21.

A pair of double channel longitudinal sheet metal edge support ribs 40 extend along the underside 13 of the entire length of the top 10 and nest into the "c"-channels 14 and 16 as shown to provide both lateral edge reinforcement and longitudinal beam reinforcement for the panel 6. Each double channel support 40 has a first channel formed with a horizontally extending flange 46 and a vertically extending flange 44 that nests within the respective c-channel 14, 16. Flange 46 overlies the respective flange 20 and is laminated thereto by a suitable adhesive substantially throughout the area of each flange 20, while flange 44 is coextensive with and adjacent to flange 18 and similarly laminated thereto throughout their adjacent areas. Upwardly extending web 48, horizontally extending web 50 and downwardly extending web 52 connect the first channel to a second channel.

Horizontally and inwardly extending web 54, upwardly extending web 56 and horizontally and outwardly extending flange 58 form a second channel of double channel edge support 40. Flange 58 is laminated to the underside 13 of the top 11, substantially throughout the area of flange 58, by adhesive. A portion of lower web 54 forming the second channel of double channel support 40 is cut back from the edge 22 to provide a bottom opening to allow the insertion of tubular leg support 100 as described below.

An identical double channel support 40 is arranged along the opposite longitudinal edge and is attached in the same manner. Thus, a box beam is provided along each edge, plus reinforcement of the side edges for ruggedness to resist deformation.

A pair of longitudinal hat shaped sheet metal rib supports 60 also are disposed along the underside 13 of the top portion 11 and extend the full length of the top. The pair of hat shaped rib supports 60 are equally spaced relative to the pair of double channel longitudinal edge supports 40. Each hat shaped rib support 60 has a pair of outwardly extending flanges 62 parallel with the underside 13 of the table top 10 and adhesively laminated thereto in the manner noted above. The ribs 60 also provide support in the longitudinal direction of the table top 10 to prevent sagging. The outward disposition of the flanges 62 renders them accessible to facilitate applying pressure in the laminating process.

The edge supports 40 and ribs 60 preferably are formed of the same thin sheet metal stock as the top panel 10, including the pre-applied finish coating(s). Adhesive lamination securement is preferred so as not to damage the pre-finished surfaces of the sheet metal.

A pair of end caps 80 span the ends and eliminate sagging across the width of the top 11. Each end cap 80 is a rigid component being formed of a molded structural plastic or the like, having a series of stub protrusions or "plugs" 82 which extend into the open ends of the sheet metal top structure 10 and engage in the ends of the longitudinal rib supports 40 and 60 to provide transverse rigidifying support for the top portion 11. In this embodiment the outer plugs 82 engage in the outer sections of the double channel edge supports 40, in abutting relation to the outer flanges 44 to maintain their predetermined spacing when the top panel portion 11 bears a load. The inner plugs 82 engage in the hat shaped rib supports 60 respectively. However, in alternative designs similar protrusions could straddle some or all of these components 40, 60 respectively and engage their outer walls for similar support purposes.

The protrusions 82 are large enough in proportion to the openings in the channels to snugly fit within the open ends of the channels. Thus, the caps 80 provide a spacing or tensioning effect of the sheet metal top portion 11 across its width, that is from front to back. This tensioning effect as well as the vertical support of the intermediate rib channels 60 increases the rigidity of the sheet metal top portion 11 in the vertical direction thus preventing sagging under normal desk top loadings.

In addition to the protrusions 82, the end piece 80 includes a pair of narrow wedge shaped extensions 84. When the end piece 80 is inserted into the open end of panel top 10, the wedge shaped protrusions 84 extend into the inner second channel of each double channel support 40. It is this second channel that receives the leg supports 100 for supporting the table. Thus the wedge shaped extensions 84 abut inserted respective legs 100, as well as the underside 13, and fixedly seat the leg supports in the second channels.

The leg support 100 is comprised of two L-shaped portions 102 and 104 and a telescoping joinable U-shaped bight portion 106. The L-shaped portions 102 and 104 each have a vertically extending section 108 and a horizontally extending section 110 formed by bending a straight piece of tube stock. The U-shaped bight portion 106 is made from a single piece of tube stock and telescopes into the distal ends of the vertically extending sections 108 of the L-shaped portions 102 and 104. The horizontally extending section 110 of each L-shaped portion 102 and 104 is inserted into the second channel of the double channel edge support 40, as seen in FIGS. 1, 6, and 7. The horizontally extending section 110 thus rests against outwardly extending flange 58 which is affixed to the underside 13 of the top 11 providing support for the panel. Section 110 contacts the panel top 10 for providing vertical support where there is a double layer of sheet metal thus avoiding any bowing of the surface 12. Additionally the horizontally extending sections 110 provide added strength in the longitudinal direction of the top. As noted above, the lower flanges 54 are relieved at their ends, as at 112 in FIG. 6, to accommodate the intervening bend portions of the leg portions 102, 104. The manner of securement of the upper ends of the U-shaped leg assembly, and its shape, assure a firm leg assembly and stable leg function, in a very simple structure which can be marketed unassembled yet be easily and reliably assembled by a purchaser.

As indicated above, after the legs are inserted, the end pieces 80 having protrusions 82 and wedge shaped extensions 84 are inserted into the open ends of the respective channels. The wedge shaped extensions 84 firmly seat the horizontally extending sections 110 of legs 100 in the double channel edge support 40.

Securement means are provided to retain the end caps, and therefore the legs, in assembled positions, such as screws 120 through the flanges 46 and rib channels 60 into the protrusions 82.

In the preferred embodiment a leg support 100 provides support for one end of the top 10, while the other end is supported by a filing cabinet pedestal C. The desk top 6 is held in contact with the filing cabinet by double sided foam tape 86 (FIG. 6) on the underside the desk top 6, on channels 60, for adhesive interfacing with the top surface of the filing cabinet.

In an alternative embodiment the leg supports 100 need not be utilized as the table top 6, with end pieces 80 in place, may rest upon independent support means such as a pair of spaced file cabinets as shown in FIG. 2.

Additionally a conventional desk drawer 110 may be included. As shown in FIG. 6, a pair of c-channel slide supports 118 are attached to the underside 11 of the table top 10 perpendicular to the hat shaped rib supports 60. A drawer 110, preferably plastic or other lightweight material having outwardly extending flanges 114 along a pair of opposed edges is inserted between the c-channels 118. The outwardly extending flanges 114 slidably fit within the spaced c-channels 118 which provides a guidance track and support for the drawer 110.

In another alternate embodiment illustrated in FIG. 8, furniture panel 126 of similar construction to panel 6 may be utilized as an end support structure, with its reinforcing ribs disposed vertically, to support a horizontal top panel 6. An end cap 180 having a first group of protrusions 82 extending horizontally to engage panel 6 as described above and a second group of similar protrusions (not shown) extending downward at 90) thereto, at the lower side of member 180, correspondingly engage panel 126 apart can be utilized to join top panel and the vertically extending support panel.

From the foregoing it will be seen that the present invention provides a lightweight and rigid construction for a furniture panel. While a preferred embodiment of the invention in the form of a desk top has been shown, it will be understood that the invention is not limited thereto since modifications may be made by those skilled in the art, particularly in light of the foregoing teachings.

What is claimed is:

1. A desk top panel construction comprising:

a thin sheet of metal including a planar top panel portion having opposed longitudinally extending side edges and opposed end edges, and depending flanges extending along said opposed side edges and attached to said top panel portion;

a plurality of support ribs formed of thin sheet metal and disposed on the underside of said top panel portion, each of said support ribs extending longitudinally between said end edges and being of a cross section which includes a vertically disposed body portion and at least one lateral flange affixed to the underside of said top panel portion; and a rigid end cap extending between and providing lateral support for said depending flanges at said side edges of said top panel portion and in vertical support engagement with said top panel portion and each of said support ribs, whereby said thin sheet metal top panel portion provides a planar desk top surface.

2. The invention as in claim 1 wherein said support ribs are independent of one another.

3. The invention as in claim 1 wherein at least two of said support ribs are channel-shaped in cross section and are on the underside of said top panel portion with one in abutting relation with each of said depending flanges.

4. The invention as in claim 3 wherein each of said end caps includes portions engaging within the respective end of each of said channel-shaped support ribs.

5. The invention as in claim 4 wherein said channel-shaped support ribs are adhesively laminated to said depending flanges and to the underside of said top panel portion throughout their length.

6. The invention as in claim 5 and wherein said lateral flange of each of said support ribs is adhesively laminated to the underside of said top panel portion.

7. The invention as in claim 5 including support ribs of a cross section providing an open channel portion and oppositely extending flanges, and wherein said last-mentioned support ribs are disposed between said support ribs which are laminated to said depending flanges, said oppositely extending flanges are adhesively laminated to said underside of said top panel portion, and each of said rigid end caps includes portions engaging within the respective end of each of said channel portions of said support ribs.

8. The invention as in claim 1 wherein each of said support ribs is channel shaped in cross section with at least one flange extending from a side thereof throughout the length of the respective rib and adhesively laminated to the underside of said top panel portion throughout the length of the rib.

9. A desk assembly comprising:

a rectangular piece of sheet metal having a planar top surface, an underside, spaced longitudinal side edges, spaced end edges extending between said longitudinal side edges, and integral flanges formed along each longitudinal side edge;

a channel shaped edge reinforcement member adjacent to each of said integral flanges and affixed thereto and each having an open channel and adjacent at least one of said end edges;

leg supports including mounting extensions insertable into said open ends of said channel shaped edge reinforcement members; and, a pair of rigid end plates overlying said end edges and including a plurality of protrusions engageable with said leg supports for retaining said leg supports in engagement in said edge reinforcement members.

10. The invention as in claim 9 wherein said rigid end plates also include protrusions fitting with said open ends for supportably engaging said edge reinforcement members to support said top surface.

11. The invention as in claim 10 including longitudinally extending channel shaped support ribs disposed between said reinforcement members and secured to the underside of said surface portion, and said rigid end plates including protrusions which engage said support ribs.

12. A desk assembly comprising:

a desk top panel including a sheet of metal defining a planar rectangular surface portion having longitudinal side edges and end edges and an integral c-shaped channel extending along each of said longitudinal side edges of said rectangular surface portion, each of said c-shaped channels including a vertical edge flange depending from the respective side edge of said rectangular surface portion and an inwardly projecting flange in spaced parallel relation with the underside of said rectangular surface portion, a sheet metal reinforcement member interfitting with each of said c-shaped edge channels and complementary therewith and with said surface portion to form a box beam extending along each of said longitudinal side edges, each of said reinforcement members including an inner vertical flange spaced inwardly of said vertical edge flange of the respective c-shaped channel and a further flange extending from said inner vertical flange and secured to the underside of said surface portion, a rigid end cap extending across each end edge of said surface portion between said box beams and having protrusions engaging the respective adjacent end of each of said box beams, and tubular support leg components each including a generally horizontal portion insertable into an end portion of one of said box beams and a vertical portion for supporting at least one end of said desk top panel, said rigid end caps including portions which retain said legs in said box beams.

13. The invention as in claim 12 wherein said sheet of metal is thin sheet metal and said rigid end caps engage said box beams to maintain said beams in predetermined spaced relation with respect to one another to support said top surface portion in a plane.

14. The invention as in claim 13 wherein each of said reinforcement members includes a flange which is substantially coextensive with said vertical edge flange of the respective c-shaped channel and is adhesively laminated thereto substantially throughout the area thereof and a horizontal portion which is adhesively laminated to said inwardly extending flange of the respective c-shaped channel substantially throughout the area of said inwardly extending flange, and said further flange of each of said reinforcement members is adhesively laminated to the underside of said rectangular surface portion.

15. The invention as in claim 14 and wherein said panel includes longitudinally extending support ribs disposed between said box beams and adhesively secured to the underside of said surface portion.

16. The invention as in claim 15 wherein each of said support ribs is of a cross section providing an open channel portion and oppositely extending flanges which are adhesively laminated to said underside of said surface portion, and each of said rigid end caps includes portions engaging within the respective end of each of said channel portions of said support ribs.

17. A substantially rigid furniture panel comprising:

a sheet of thin sheet metal defining a generally rectangular planar surface portion having a pair of longitudinal edges, a pair of end edges, an upper surface, and an underside, and integral channels formed along each longitudinal edge of and depending on the underside of said planar surface portion;

an edge reinforcement member of thin sheet metal fitting against each of said integral channels and affixed thereto to form reinforced channels;

at least one longitudinally extending support disposed between and in parallel spaced relation to said reinforcement members and affixed to the underside of said surface portion;

a pair of rigid end plates for interfittingly engaging the end edges of said support portion and having a plurality of protrusions for engaging portions of said reinforced channels, whereby said surface portion is maintained planar.

18. The invention as in claim 17 wherein each of said reinforcement members is adhesively laminated to the respective integral channel and to said underside.

19. The invention as in claim 18 wherein each of said integral channels is L-shaped, including a depending leg and a distal leg extending inwardly of said panel from said depending leg, and each reinforcement member includes a flange which is substantially coextensive with said depending leg of the respective integral channel and is adhesively laminated thereto substantially throughout the area thereof and a further portion which is adhesively laminated to said inwardly extending flange of the respective integral channel substantially throughout the area of said inwardly extending flange.

20. The invention as in claim 9 wherein each of said integral flanges includes a first flange portion depending from the respective longitudinal side edge of said rectangular piece of sheet metal and an interiorly extending second flange portion whereby a C-shaped channel is provided along each of said longitudinal side edges.

21. The invention as in claim 1 wherein each of said depending flanges has a terminal edge disposed beneath the respective side edge portion of said planar top panel.

22. The invention as in claim 17 wherein each of said integral channels has a terminal edge disposed beneath the respective side edge portion of said planar top panel.

* * * * *

UNITED STATES PATENT AND TRADEMARK OFFICE
CERTIFICATE OF CORRECTION

PATENT NO. : 5,152,591

DATED : OCTOBER 6, 1992

INVENTOR(S) : RALPH BEALS

It is certified that error appears in the above-identified patent and that said Letters Patent is hereby corrected as shown below:

Column 2, line 62, after "FIG." insert — 4 is a —. Column 2, line 63, after "as" insert — in —. Column 3, line 34, delete "37" and substitute therefor — " —.

Signed and Sealed this

Ninth Day of November, 1993

Bruce Lehman

*Attest:*

BRUCE LEHMAN

*Attesting Officer*

*Commissioner of Patents and Trademarks*